US010322047B2

(12) United States Patent
Schrader

(10) Patent No.: US 10,322,047 B2
(45) Date of Patent: Jun. 18, 2019

(54) SECURE TRANSFER RAMP FOR CAR TO WHEELCHAIR

(71) Applicant: Timothy Michael Schrader, Boynton Beach, FL (US)

(72) Inventor: Timothy Michael Schrader, Boynton Beach, FL (US)

(73) Assignee: Timothy Schrader, Boynton Beach, FL (US)

( * ) Notice: Subject to any disclaimer, the term of this patent is extended or adjusted under 35 U.S.C. 154(b) by 83 days.

(21) Appl. No.: 15/275,348

(22) Filed: Sep. 24, 2016

(65) Prior Publication Data

US 2017/0165137 A1 Jun. 15, 2017

Related U.S. Application Data

(60) Provisional application No. 62/274,507, filed on Jan. 4, 2016.

(51) Int. Cl.
*A61G 7/10* (2006.01)

(52) U.S. Cl.
CPC ..... *A61G 7/103* (2013.01)

(58) Field of Classification Search
CPC ..... A61G 7/1025; A61G 3/06; A61G 3/061; A61G 7/103; B60N 2/245
USPC ..... 5/81.1 R, 81.1 HS; 296/65.01, 65.04; 414/537, 921; 14/71.1; 280/304.1
See application file for complete search history.

(56) References Cited

U.S. PATENT DOCUMENTS

| | | | | | |
|---|---|---|---|---|---|
| 2,919,658 | A * | 1/1960 | Kakoska | A61G 3/06 | 104/94 |
| 3,469,880 | A * | 9/1969 | Woodward | B60N 2/245 | 296/64 |
| 4,908,890 | A * | 3/1990 | Beckman | A61G 5/10 | 5/81.1 R |
| 5,207,549 | A * | 5/1993 | Riva | A61G 3/02 | 224/407 |
| 5,435,614 | A * | 7/1995 | Nordberg | A61G 3/06 | 296/209 |
| 6,129,403 | A * | 10/2000 | Townsend | B60N 2/245 | 296/65.01 |
| 8,990,976 | B1 * | 3/2015 | Saccone | A61G 3/02 | 296/65.01 |
| 2012/0013102 | A1 * | 1/2012 | Gao | A61G 3/02 | 280/304.1 |
| 2013/0117928 | A1 * | 5/2013 | Hardie | A47K 3/282 | 4/611 |

* cited by examiner

*Primary Examiner* — Sarah B McPartlin

(57) ABSTRACT

Transfer ramp for Car to wheelchair. This new design safely helps transfer someone from or to the car or wheelchair. This design is self-supporting between the lower structure of the car seat, car structure under the door, the outboard floor riser ledge of car structure under the door and the rear vertical support column of the door frame. It is only supported from the car side. The person can actually sit on the edge of the board before sliding over to the wheelchair. It is more of a platform than a transfer board. It is more fixed than a standard transfer board that is commonly available on most of the market. This design minimizes the 12" gap that exists between the car seat and wheel chair when using a standard transfer board.

2 Claims, 2 Drawing Sheets

PLAN VIEW

END VIEW

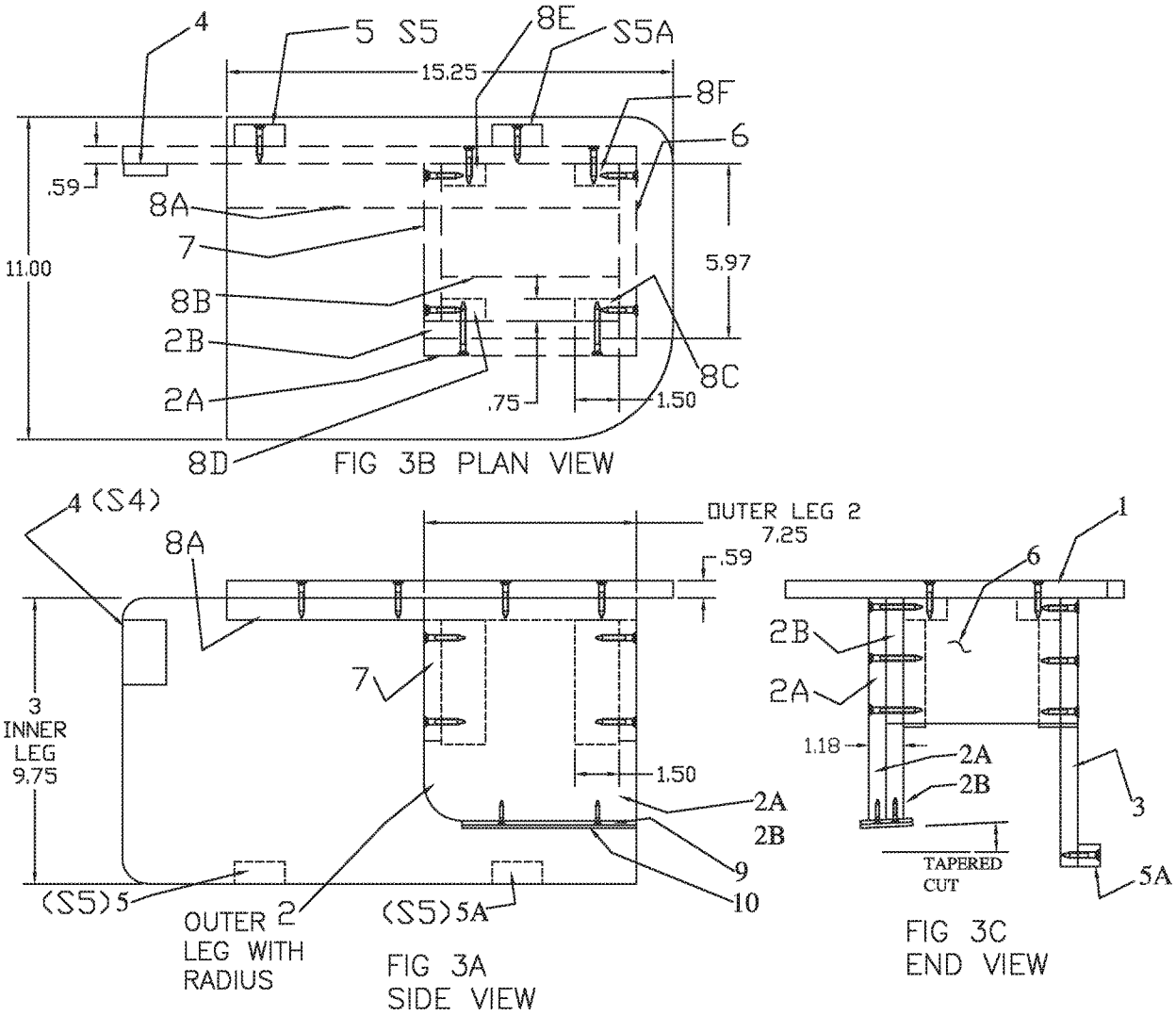
8F
6
5.97
8C
S5A
1.50
8E
.75
15.25
5 S5
4
8A
7
8B
2B
2A
8D
.59
11.00
FIG 3B PLAN VIEW
1
3
5A
6
2A
2B
TAPERED CUT
FIG 3C END VIEW
2B
2A
1.18
OUTER LEG 2 7.25
.59
2A
2B
9
10
1.50
(S5) 5A
FIG 3A SIDE VIEW
7
OUTER 2 LEG WITH RADIUS
8A
4 (S4)
(S5) 5
3 INNER LEG 9.75

SECURE TRANSFER RAMP FOR CAR TO WHEELCHAIR

CROSS REFERENCE TO RELATED APPLICATION

This application claims the benefit of U.S. Provisional application 62/274,507 filed on Jan. 4, 2016.

STATEMENT REGARDING FEDERALLY SPONSORED RESEARCH AND DEVELOPMENT

Not Applicable

NAMES OF THE PARTIES TO A JOINT RESEARCH AGREEMENT

Not Applicable

REFERENCE TO A SEQUENCE LISTING

Not Applicable

STATEMENT REGARDING PRIOR DISCLOSURES BY THE INVENTOR OR A JOINT INVENTOR

Not applicable.

BACKGROUND OF THE INVENTION

Problem Solved

When using a standard transfer board to go from the car to wheelchair (or vice versa) it is possible to slip off the board and the person ends up on the floor board of the car or the ground. This has happened to my wife and is very humiliating for her. Many people buy expensive wheelchair vans to avoid this. The standard transfer board is what the majority of the market offers for lower cost solutions. Most are simple boards with various widths and length.

The standard transfer board is supported by the wheelchair seat and the car seat. A 13" gap exists with the 2013 VOLT and other cars where it is possible to slip off these standard boards, as the person slides across the board to the car seat. Other people in the rehabs have complained about feeling insecure on the standard transfer boards and falling off as they are sliding to the car seat.

BRIEF SUMMARY OF THE INVENTION

My Transfer Ramp design allows a person to transfer from a car seat to a wheelchair or vice versa. The ramp is composed of a top platform (or seat), an inner leg, an outer leg and contact supports to the car. This design is self-supporting by car floor between the seat and car frame under the door, Car seat lower structure, Outboard door ledge and vertical support column of door frame. The inner leg is supported by the car floor between the car seat and door framing. The outer leg is supported by the outboard door ledge of the car framing under the door. Sometimes referred to as the door sill. The car framing under the door is like a hump in the car frame under the car door with a stepped structure. The outboard door ledge is the outer part of this stepped structure. Other contact blocks are added for additional stability as further explained in the "Detailed Description of the Invention" section.

One block contacts the car at the inside surface of the vertical support column of the door frame. This prevents the Transfer ramp from tipping over when the load is on the edge of the Ramp seat. The inner leg contacts the car seat lower structure providing additional contact support that prevents the transfer board from tipping over. The gap between the car seat and wheelchair is minimized to within about 1-2" between the wheel chair and car seat. When using the standard Transfer board this gap is 13". There are no extraneous legs to the ground from the transfer ramp that can interfere with positioning wheelchair close to the edge of the transfer ramp. It is only supported from the car structure and does not depend on the wheelchair to support one side of the board as the standard transfer ramp requires. This takes up valuable space that makes it harder for the person to move off the standard transfer board. The car structure does not need to be modified, drilled or seat removed to add brackets. At substantial costs.

The person can actually sit on the edge of the board before sliding over to the wheelchair. It is more of a ramp/platform/seat then a transfer board. It is more fixed and less likely to move then a standard transfer board.

DESCRIPTION OF DRAWING

See the accompanied drawing FIGS. 1, 2, 3A, 3B and 3C for a visual representation of the details discussed in "Brief Summary of the Invention" and the "Detailed Description of the Invention sections"

FIGS. 3A, 3B and 3C is an orthographic representation of the transfer board structure only. FIG. 3A is the side view, FIG. 3B the plan view of the transfer board only, which is also shown in FIG. 2.

DETAILED DESCRIPTION OF THE INVENTION

Figure 2:
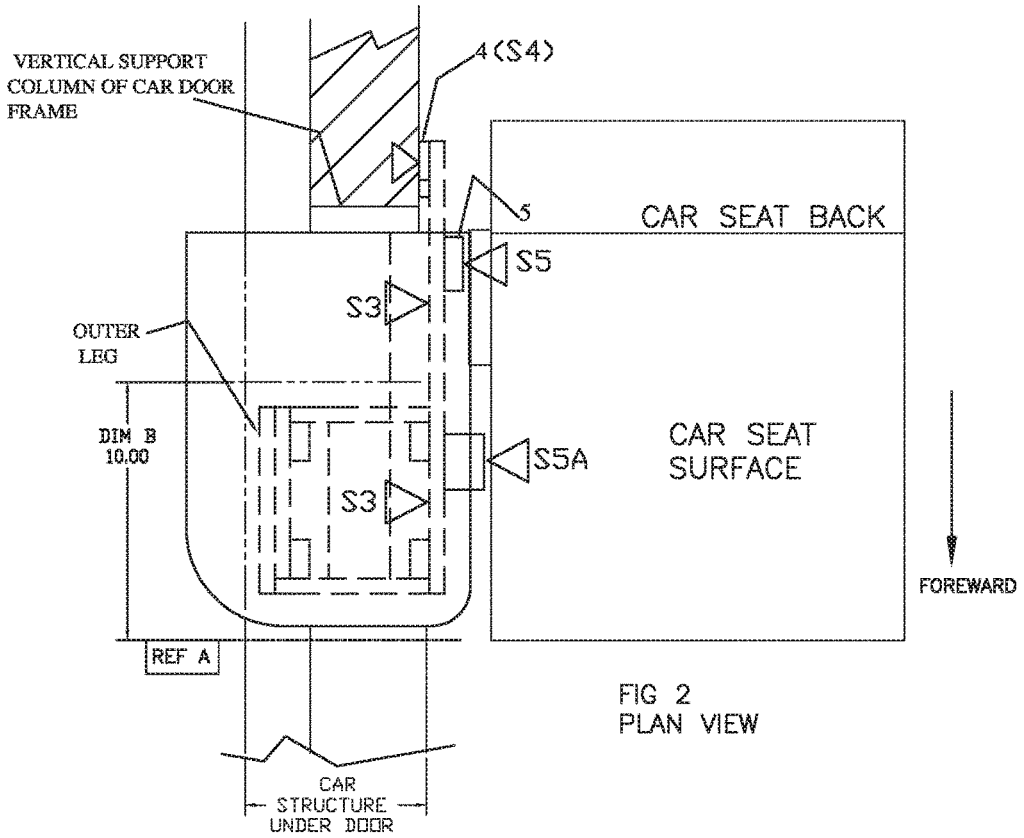
FIG. 2 shows the plan view of the transfer ramp in the car which is next to the car seat. All contact points/surfaces to the car are labeled S1 thru S5 in FIGS. 1 and 2 and further described in the "How this invention works" section
Figure 1:
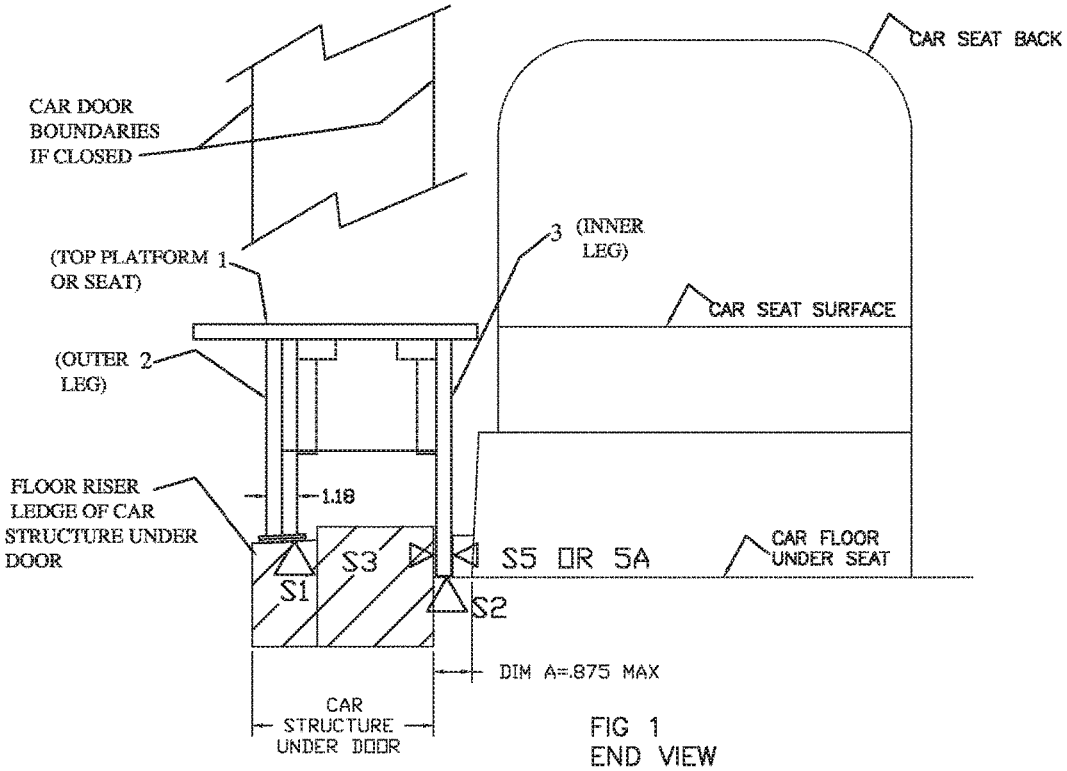
FIG. 1 shows a end view cross section of the transfer ramp at the car seat. It shows how the removable transfer ramp is supported securely in the car, along with FIG. 2. This end view could also be described as a transverse cross section of the car at the car seat just in front of the transfer ramp.

My design is self-supporting between the lower structure of the car seat, car structure under the door, floor riser ledge of car structure under the door by the 5 support points or areas shown in the FIGS. 1 thru 3. It is only supported from the car side. The design allows a person to transfer from a car seat to a wheelchair or vice versa. The Ramp dimensions may vary with the car dimensions to accomplish this support without any permanent attachments or screws between the car and board. The board is removable for ease of use. The person can actually sit on the edge of the board before sliding over to the wheelchair. It is more of a platform then a transfer board. It is more fixed then a standard transfer board.

The Major Components:

How the transfer ramp works or the relationship between the components is discussed in the next section. The Transfer Board is comprised of the following component materials.

The Version of The Invention Discussed Here Includes the following materials:

1. ⅝ in plywood cut into seven panel shapes or parts
2. 1×2 wood
3. Wood screws #10×¾ in
4. Wood Screw #10×2 in
5. Wood screw #10×1¼ in The ⅝ Plywood is cut into 7 panel parts or shapes. This includes the top platform 1 (FIG. 3C), the inner leg 3 (FIGS. 3C and 3A), the outer leg pieces 2A and 2B (FIGS. 3C and 3B), a forward gusset 6 (FIGS. 3B and 3C), a rear gusset 7 (FIGS. 3B and 3A).

There is a top shelf or platform 1 (FIG. 3C) that the person slides over. The inner leg 3 works against the car frame and lower floorboard riser ledge for support. As shown by supports S1 thru S5 in the drawing figures. Other parts shapes act as gussets to strengthen the resistance of the board to warping or twisting under load. The 1×2 wood doublers help screw the parts/shapes/panel together. Without these doublers the plywood could split when screwing the panels together. Items 8A thru 8F (FIGS. 3A, 3*b* and 3C) are all comprised of various lengths of 1×2 wood. These make up the re-enforcing doublers for the six panels of the ramp. They provide a framework to screw the ⅝" panels together. Screwing into the edges of plywood could split the plywood. These 1×2's provide rigidity to the ⅝ plywood parts. Horizontal item 8A (FIGS. 3B and 3A) allows the screwing of inner leg 3 to top platform 1. Horizontal item 8B allows the screwing top platform 1 to the outer legs 2A and 2B. Vertical 1×2 items 8C and 8D (FIGS. 3B and 3A) allow the screwing of the outer leg 2A and 2B to the Forward panel Gusset 6 and the Rear panel gusset 7. In a similar way the vertical 1×2's 8E and 8F (FIG. 3A) allow the inner leg 3 to be reinforced and screwed to the rear panel gusset 7.

The leg panels 2A and 2B (FIG. 3C) of the outer leg are cut at an angle at the bottom of the legs to match the tapered angle of the 'floor riser ledge of car structure under door' as shown in FIG. 1. This is a critical design feature that allows this design to work without damaging the car floor riser ledge under the door. Anything smaller than 1.18" will absolutely not work on a VOLT and many other cars. The load must be spread over a large enough area to reach support stiffeners under the car riser ledge, whose exact location is not always known. This information is difficult to obtain from multiple manufactures but the location can be estimated.

How the Invention Works:

The transfer ramp is composed of a top platform (or seat), an inner leg, a outer leg and contact supports to that car labeled S1 thru S5. These are shown in FIGS. 1, 2, 3A, 3B and 3C. This design is self-supporting by the fit between the car floor between the seat and car frame under the door, Car seat lower structure, Outboard door ledge and vertical support column of door frame. The inner leg is supported by the car floor in the 0.75" gap between the car seat and car structure under door. This is shown as support S2 or 3 (FIG. 1). This is a critical dimension which allows this design to work. The outer leg 2 (FIG. 1) of the Schrader design is supported by the outboard door ledge which acts as support S1 (FIG. 1) of the car structure under the door. The outer leg 2 is comprised of two cut pieces of ⅜ plywood shown as 2A and 2B (FIGS. 3C and 3B). The car framing under the door is like a hump in the car frame under the car door with a stepped structure. The outboard door ledge is the outer part of this stepped structure. Other contact blocks are added for additional stability and to provide resistance against any overturning or tipping moments. This can happen when someone is on the very outboard edge of the top platform as they are moving over to the wheelchair seat. When this happens all vertical weight will be supported by the outer leg when the weight is outboard of the outer leg. One block that resists this moment is located on the inside top surface of the transfer ramp contacts the car at the inboard surface of the vertical support column of the door frame This block acts as support S4 or 4 (FIGS. 2, 3A and 3B). The inner leg contacts the car seat lower structure providing additional contact support that prevents the transfer board from tipping over. This is shown as support contact S5 or block 5 (FIGS. 2, 1, 3A and 3B). The prototype did not require this block 5 to make this contact with the VOLT car, but other cars may need this block 5. This resistance to overturning moments may need to be done at S5A or 5A (FIG. 1, 2, 3A or 3B) on some cars. Although it was not required on the prototype. In summary, the overturning/tipping moments are resisted by supports S4 and S5 as can be best seen in FIG. 1.

Support S3 (FIG. 2) is also required between the inner side of the inner leg 3 and the side of the 'car structure under door' (FIG. 1). This provides additional stability and insures the Ramp will not move in an outboard lateral direction while someone is on the top platform 1. This support S3 may require an additional support block (not shown). This block was not required on the prototype as the inner leg 3 has natural contact to the inboard vertical surface of the 'car structure under the door' to the inside surface of the Transfer Ramp.

The transfer ramp assembly works by providing support point between the board ramp and the car. The panel dimensions are dependent on the car dimensions to accomplish this support without any permanent attachments or screws between the car and board. The board is removable for ease of use.

How to Make the Invention:

Components can be readily bought at any major hardware store. Assembly is simple as shown in the drawing figures. Additional drawing pages which detail the exact assembly steps are available but not required as part of this document. A chart is also provided in the additional assembly instructions showing how to take measurements for the car the ramp will be made for. The chart also shows how to calculate the required board dimensions from the Car dimensions.

All items shown are required. Additional supports can be added, if required. These are shown as supports S4 and S5 in the available drawing.

The dimensions of the board can be adjusted to fit any number of cars. The prototype board shown in the drawing is for a 2013 or 2015 VOLT.

All items shown are required. Additional supports can be added, if required. These are shown as S4 and S5 in the available drawing figures.

This ramp could be also be made of plastic, metal or carbon fiber. Some design details would be modified or changed to adapt to available materials. It could also be designed to be adjustable for various car. But that is not addressed in this document.

How to Use the Invention:

Once the board dimensions have been adjusted to fit the particular car model it becomes a snug fit. The operator simply places the board between the seat, floor board riser ledge and door frame. It is then ready to be used. My wife has used this for 3 years. It has improved how secure she feels during transfers.

The invention claimed is:

1. A portable and removable transfer ramp for helping handicapped people enter and exit a seat within a car, comprising:

a platform;

an inner leg extending downward from the platform, the inner leg having a thickness of less than ⅞ of an inch and is configured to fit between an outboard side of the seat and an under door car structure;

an outer leg extending downward from the platform, the outer leg is spaced apart and parallel to the inner leg and the outer leg is shorter in height and in length than the inner leg;

at least one support block located on an inner surface of the inner leg;

at least one additional support block located on an opposite outer surface of the inner leg, wherein the at least one support block and the at least on additional support block are configured to contact the car and the seat to provide stability against overturning moments when a user is positioned on an outboard edge of the platform;

a first panel gusset extending between a first end of the outer leg and a first end of the inner leg;

a second panel gusset extending between a second end of the outer leg and the inner leg;

wherein the portable and removable transfer ramp is configured to be fully supported by the car and the seat.

2. The portable and removable transfer ramp of claim 1 further comprising an aluminum plate with rubber pad positioned at a bottom surface of the outer leg to spread a contact load of the outer leg over a wider surface area to help prevent damage to an underlying support surface.

* * * * *